US007536832B2

(12) United States Patent
DeYoung

(10) Patent No.: US 7,536,832 B2
(45) Date of Patent: May 26, 2009

(54) MOUNTING BRACKET FOR A SHADE

(75) Inventor: Steve DeYoung, Cadillac, MI (US)

(73) Assignee: Tubelite, Inc., Reed City, MI (US)

( * ) Notice: Subject to any disclaimer, the term of this patent is extended or adjusted under 35 U.S.C. 154(b) by 261 days.

(21) Appl. No.: 11/591,758

(22) Filed: Nov. 1, 2006

(65) Prior Publication Data

US 2008/0098665 A1 May 1, 2008

(51) Int. Cl.
*E04B 7/16* (2006.01)
*E05D 5/00* (2006.01)

(52) U.S. Cl. ..... 52/74; 52/78; 16/382

(58) Field of Classification Search ..... 52/75, 52/202, 203, 473, 36.5, 74, 78, 235; 248/273, 248/250, 235; 160/83.1; 16/382
See application file for complete search history.

(56) References Cited

U.S. PATENT DOCUMENTS 782,685 A * 2/1905 Nelson ..... 16/252
1,287,409 A * 12/1918 Paige ..... 52/202
1,855,962 A * 4/1932 Harry ..... 52/473
2,140,412 A * 12/1938 Banks ..... 16/352
2,486,660 A * 11/1949 Kurtz ..... 52/473
2,807,061 A * 9/1957 Stone ..... 52/74
2,807,062 A * 9/1957 Sikkema et al. ..... 52/473
3,129,471 A * 4/1964 Johnson et al. ..... 49/64
3,149,381 A * 9/1964 Santo ..... 49/71
3,545,135 A * 12/1970 Lieber ..... 49/505
3,591,247 A * 7/1971 Berry et al. ..... 312/304
4,360,118 A 11/1982 Stern
4,811,542 A * 3/1989 Jewell ..... 52/745.21
4,893,772 A * 1/1990 Scott ..... 248/235
5,026,015 A * 6/1991 Patrick ..... 248/248
5,062,181 A * 11/1991 Bobrowski et al. ..... 16/354
5,285,602 A * 2/1994 Felton ..... 52/36.6
5,423,149 A * 6/1995 Herbst ..... 49/382
5,570,865 A * 11/1996 Godfrey ..... 248/226.11
5,881,517 A * 3/1999 Prince et al. ..... 52/238.1
6,131,354 A * 10/2000 Thompson ..... 52/511
6,421,966 B1 * 7/2002 Braunstein et al. ..... 52/173.3
6,729,076 B1 * 5/2004 Gale ..... 52/74
2002/0069597 A1 * 6/2002 Gorder ..... 52/204.1
2004/0040230 A1 * 3/2004 Taegar ..... 52/202
2006/0059662 A1 * 3/2006 Roeper ..... 16/382
2006/0191234 A1 * 8/2006 Gadd et al. ..... 52/714
2007/0000200 A1 * 1/2007 Fairbairn ..... 52/473
2007/0028420 A1 * 2/2007 Lueffe et al. ..... 16/382

* cited by examiner

*Primary Examiner*—Robert J Canfield
*Assistant Examiner*—Charissa Ahmad
(74) *Attorney, Agent, or Firm*—Barnes & Thornburg LLP

(57) ABSTRACT

A mounting bracket to be used in connection with securing sunshades to a wall mullion. The mounting bracket including a pair of bracket elements matingly engageable with each other with one bracket element being securable to one mounting arm of one of the sunshades and the other bracket element being securable to one mounting arm of an other of the sunshades and with each bracket element being removably securable to the mullion, such that each bracket element is disengageable from the other bracket and removable from the mullion. A plurality of the mounting brackets may be used to secure a plurality of the sunshades in a side-by-side manner to a plurality of wall mullions.

3 Claims, 5 Drawing Sheets

MOUNTING BRACKET FOR A SHADE

BACKGROUND

This disclosure relates generally to a mounting bracket for mounting a shade, such as, for example, a sunshade.

It is well known in the art to secure in a side-by-side manner a plurality of sunshades to a plurality of wall mullions to shield sunlight from passing through windows of a building or other structure. The sunshades typically are positioned outside the building or other structure. The windows are often disposed in a side-by-side manner and each sunshade is associated with a respective window. The sunshades and the structure securing the sunshades to the wall mullion often present difficulties, however, when individual windows need to be removed, replaced or otherwise repaired or serviced.

SUMMARY

The present disclosure relates to a mounting bracket to be used in connection with securing sunshades to a wall mullion. The mounting bracket includes a pair of bracket elements matingly engageable with each other with one bracket element being securable to one mounting arm of one of the sunshades and the other bracket element being securable to one mounting arm of an other of the sunshades and with each bracket element being removably securable to the mullion. Each bracket element is disengageable from the other bracket element and removable from the mullion. A plurality of the mounting brackets may be used to secure a plurality of the sunshades in a side-by-side manner to a plurality of wall mullions secured to a building or other structure. The sunshades may be associated with a plurality of windows to shield sunlight that might otherwise pass through the windows.

Features and advantages of the disclosure will be set forth in part in the description which follows and the accompanying drawings described below, wherein an embodiment of the disclosure is described and shown, and in part will become apparent upon examination of the following detailed description taken in conjunction with the accompanying drawings.

DETAILED DESCRIPTION

Figure 1:
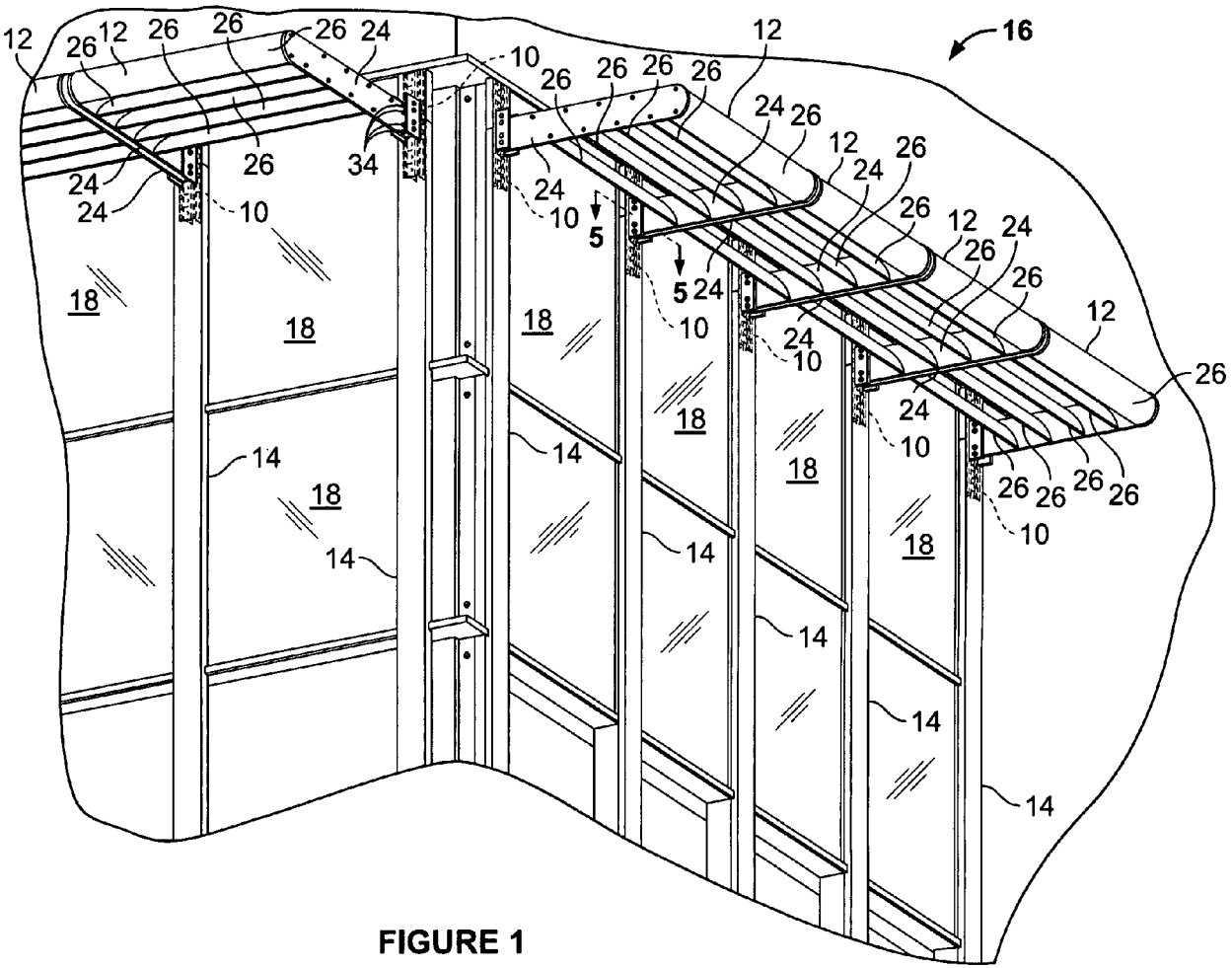
FIG. 1 is a perspective view of a plurality of mounting brackets in accordance with one embodiment of the present disclosure securing in a side-by-side manner a plurality of sunshades to a plurality of wall mullions, illustrating with broken lines the mounting brackets.
Figure 2:
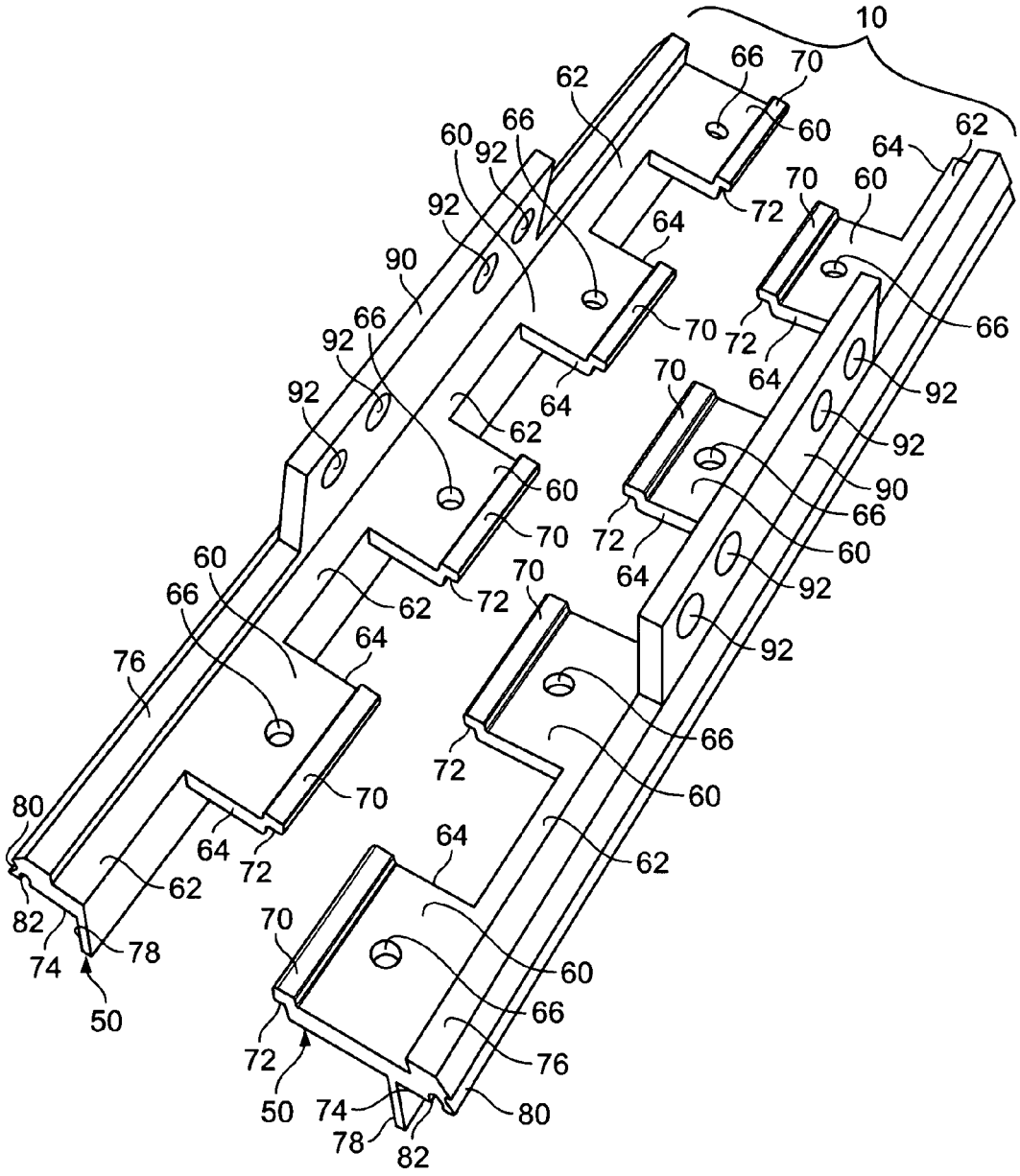
FIG. 2 is an exploded perspective view of one of the mounting brackets of FIG. 1.
Figure 3:
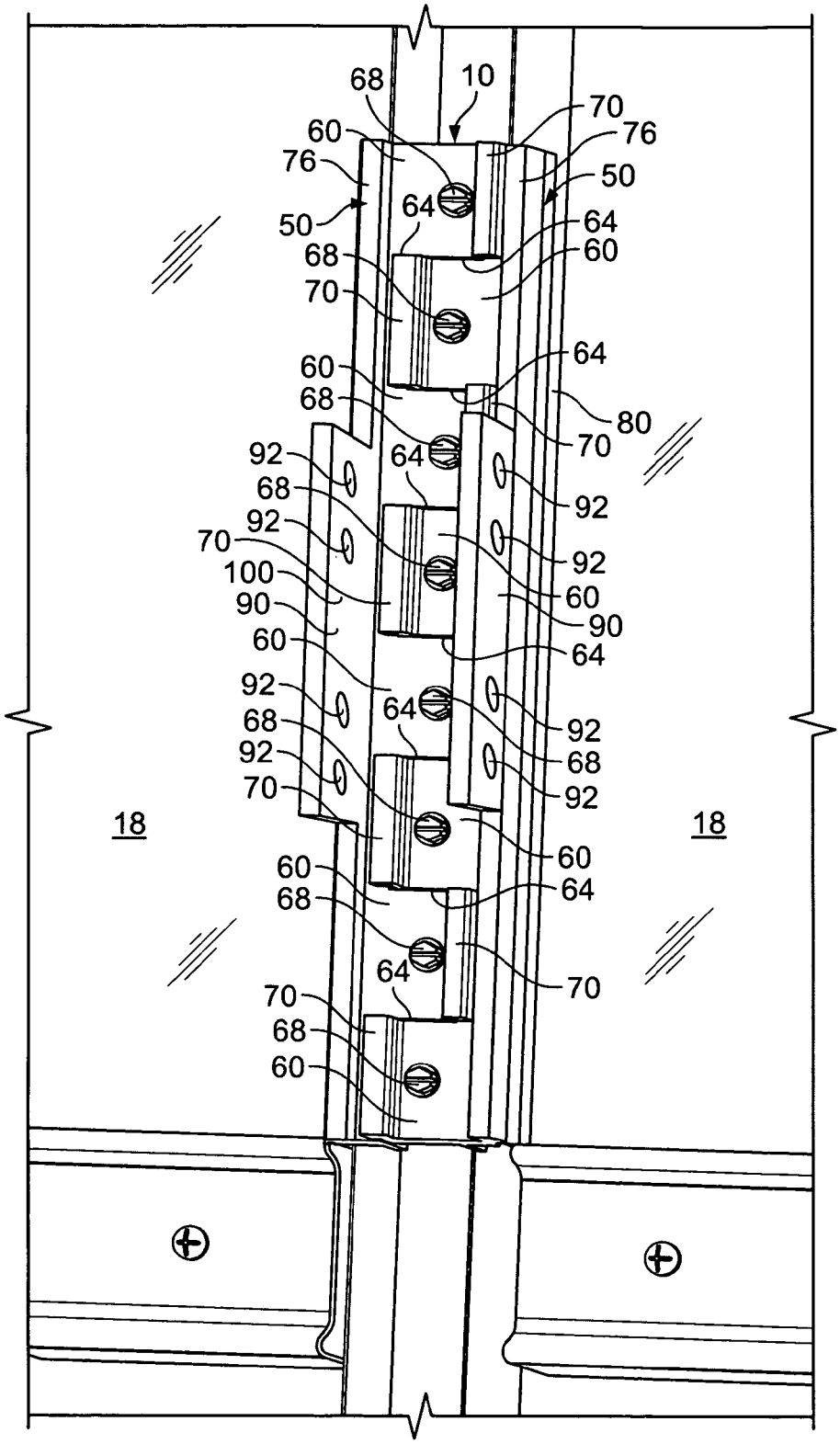
FIG. 3 is a perspective view of one of the mounting brackets of FIG. 1 removably secured to one of the wall mullions of FIG. 1 by a plurality of fasteners.
Figure 4:
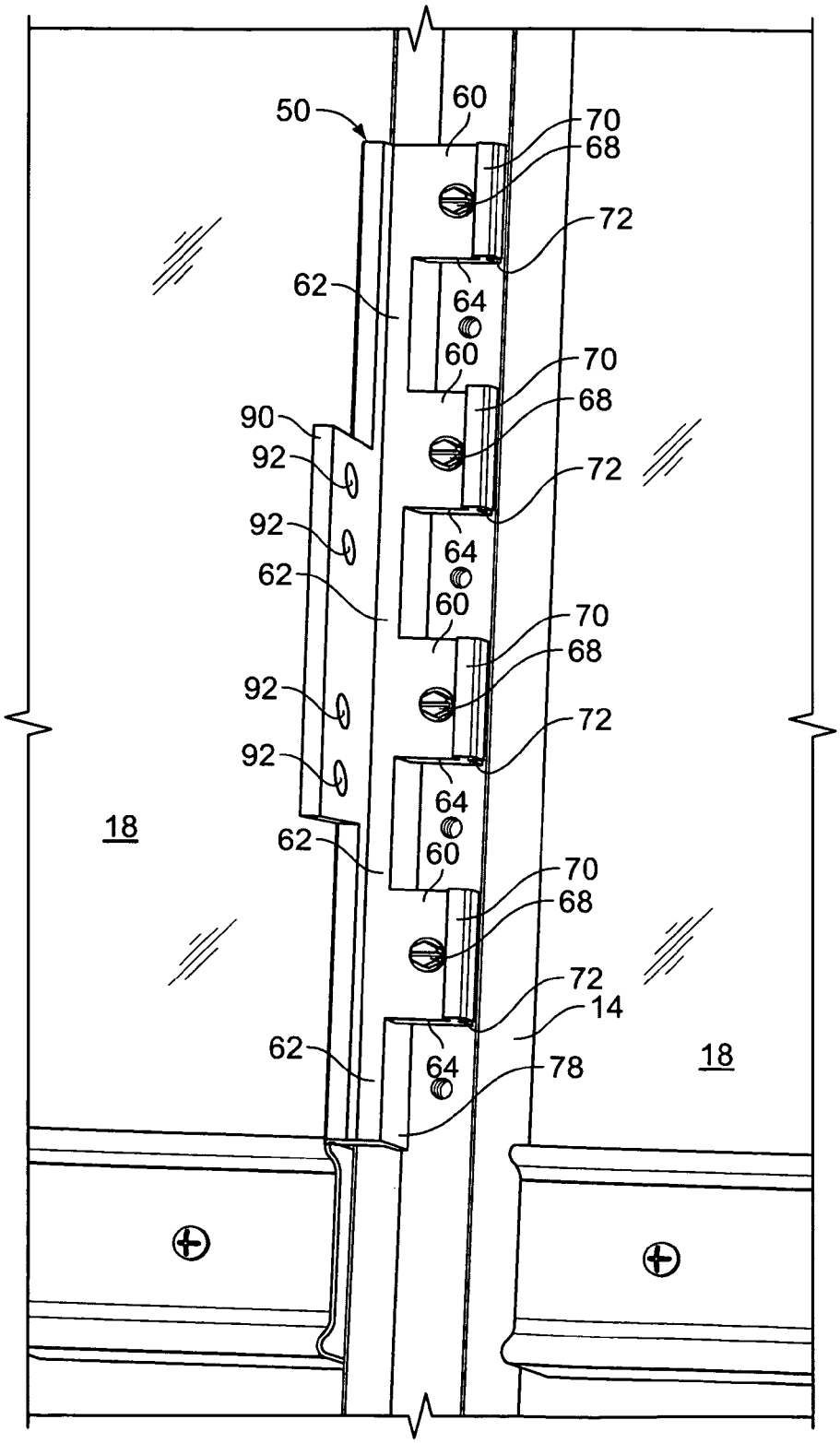
FIG. 4 is a perspective view of the mounting bracket of FIG. 1 with one of the bracket elements of the mounting bracket disengaged from the other bracket element and removed from the wall mullion.
Figure 5:
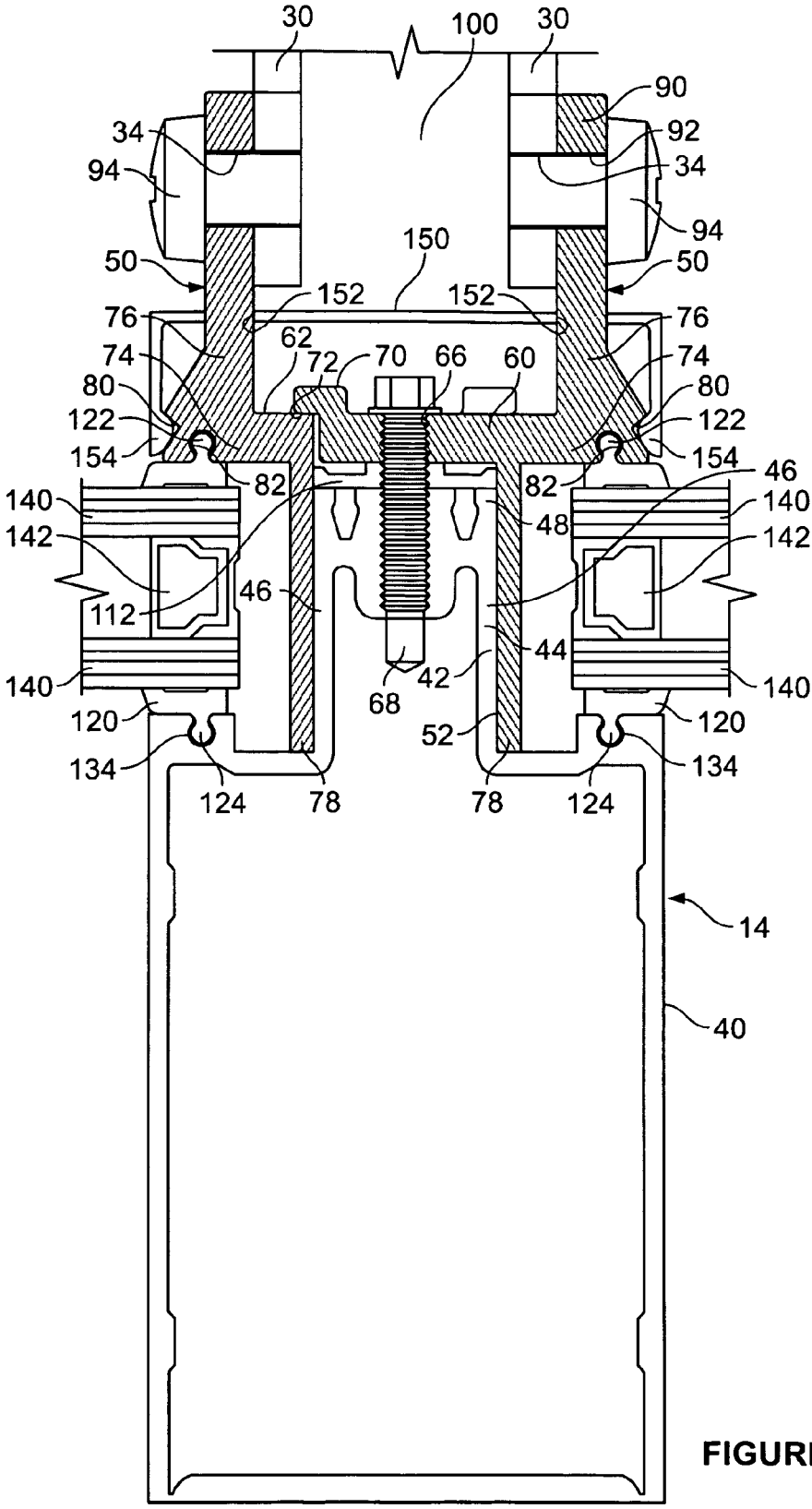
FIG. 5 is a cross section view taken along the lines 5-5 of FIG. 1.

FIG. 1 illustrates a plurality of mounting brackets 10 in accordance with the present disclosure securing in a side-by-side manner a plurality of sunshades 12 to a plurality of wall mullions 14 secured to walls of a building 16 having a plurality of windows 18. Each of the sunshades 12 provides shield to a respective window 18. Each of the illustrated sunshades 12 comprises a pair of mounting arms 24 separated by a plurality of sunshade blades 26 for shielding the sun. Each mounting arms 24 includes an end portion 30 defining a plurality of holes 34 for securing to the mounting brackets 10. Each of the illustrated wall mullions 14 comprises a hollow column 40 secured to the wall of the building 16 and a pedestal portion 44 having two sides 46 and a top 48. The hollow column 40 and the pedestal portion 44 extend along the substantial length of the wall mullion 14. In the illustrated embodiment, the wall mullions 14 are secured in a parallel manner to the wall of a building 16 and the sunshades 12 are secured to the wall mullions 14 by a plurality of the mounting brackets 10.

Each of the mounting brackets 10 in accordance with the illustrated embodiment of the present disclosure comprises a pair of bracket elements 50 that are matingly engageable with each other to define a channel 52 to receive the pedestal portion 44 of the wall mullion. Each bracket element 50 comprises a plurality of tongues 60 and a plurality of ledges 62 interconnecting the tongues 60. The tongues 60 and ledges 62 define a plurality of slots 64. Each tongue 60 has a generally square or rectangular configuration and includes at its distal end a lip 70 extending from the top of the tongue that defines a void 72. The tongues 60 and slots 64 of each bracket element 50 are disposed in an alternating manner along the length of the mounting bracket 10 so that the tongues 60 and slots 64 of one bracket element 50 matingly engage with the tongues 60 and slots 64 of the other bracket element 50 when the bracket elements 50 are matingly engaged. When the bracket elements 50 are engaged, the lips 70 of each bracket element engage the ledges 62 of the other bracket element which are received by the voids 72. Each tongue 60 defines a hole 66 for receiving a fastener 68 to secure its respective bracket elements 50 to the wall mullion 14.

Each bracket element 50 also includes an inverted L-shaped frame, including a support 78 and an engaging member 74, both of which extend along the length of the bracket element 50. The supports 78 of the mounting bracket 10 define the channel 52 for receiving the pedestal portion 44 of the wall mullion, with the support 78 contacting or otherwise engaging respective sides 46 of the pedestal portion 44. Each engaging member 74 defines on its side a V-shaped slot 80 extending along its length and defines on its bottom an accurate slot 82 extending along its length. Each bracket element 50 also includes a wall 76 extending along the length of the engaging member 74. Each bracket element 50 further includes a flange 90 for engaging one of the mounting arms 24 of one of the sunshades 12. The flanges 90 include a plurality of holes 92 for receiving fasteners 94 to secure the end portions 30 of the mounting arms 24 of the sunshade 12. When the bracket elements 50 are engaged, the flanges 90 define a channel 100 for receiving the end portions 30 of the mounting arms 24 of two sunshades 12 positioned in a side-by-side manner. The mounting bracket 10 in accordance with the illustrated embodiment of the present disclosure is securable to the wall mullion 14 to secure one or two sunshades 12 to the wall mullion. FIG. 1, for example, illustrates two of the center mounting brackets 10 engaging two sunshades 12, and the end mounting brackets 10 engaging only one of the sunshades.

Additionally, the bracket elements 50 are matingly disengageable from each so that one of the bracket elements 50 can be disengaged from the respective wall mullion and the other bracket element 14 so that it can be unsecured from its sunshade 12, while the other bracket element 50 remains secured to the wall mullion 14 and to its sunshade 12. If, for example, a window 18 breaks or is otherwise in need of replacement, repair or the like, the sunshade 12 corresponding to that window can be readily removed to allow the window to be accessed without having to remove all of the sunshades. Similarly, a single shade 12 can be removed without having to remove all of the other sunshades 12.

The mounting bracket 10 in accordance with the illustrated embodiment may be used with the any suitable sunshade 12, such as the illustrated sunshade which is known in the art. The mounting brackets in accordance with the present disclosure, however, may also be used with any other shades that extend outward from a wall of a building 16 or other structure, including for example a shade having any other type of blades 26 or any other shading structure connecting the two mounting arms Similarly, the mounting brackets 10 in accordance with the present disclosure may be used with the illustrated wall mullion 14, which is known in the art, or with any other wall mullions. With the illustrated wall mullion 14, the pedestal portion 44 includes on the top 48 structure for receiving the fasteners 68, which may be any suitable fastener, such as, for example, a self driller fastener or the like. The pedestal portion 44 is configured to be received by the channel 52 defined by the supports of the mounting bracket 10 such that the supports engage the sides 46 of the pedestal portion. A thermal isolator 112 or the like may extend along the length of the top of the pedestal portion 44. On each side of the pedestal portion 44, a glazing gasket 120, with a pair of opposed bosses 122 and 124, is engaged with a respective bracket element 50 and the column 40 of the mullion 14, with one boss 122 being received by the slot 82 defined by the bracket elements 50 and the other boss 124 being received by a slot 134 defined by the column. Also illustrated on each side of the wall mullion 14 are two glass panes 140 of one of the windows 18 and a spacer 142 that extends around the perimeter of the window which encloses the air space between the two panes. A readily removable snap-on cover 150 engages and encloses the mullion 14. Each snap-on cover 150 also defines a pair of slots 152 for receiving the flanges 90 of the bracket elements 50 of a corresponding mounting bracket 10. Additionally, each side of the snap-on cover 150 includes a boss 154 received by the slots 80 of the mounting bracket 10 to engage by snap fit the mounting bracket.

The mounting brackets 10 in accordance with the present disclosure provides many advantages. For example, when used to secure a plurality of sunshades 12 to a plurality of wall mullions 14, the mounting brackets 10 may provide easier access to individual windows. For example, when an individual window 18 needs to be removed or replaced or otherwise repaired or serviced, a single sunshade 12 may be easily removed by disengaging one bracket element 50 of each of two mounting brackets 10 that secure the sunshade 12 to the wall mullions 14. As a result, the immediately adjacent sunshades 12, as well as the other sunshades, can remain secured to the wall mullions.

While the present disclosure may be susceptible to embodiment in different forms, there is shown in the drawings, and herein will be described in detail, an embodiment with the understanding that the present description is to be considered an exemplification of the principles of the disclosure and is not intended to limit the disclosure to the details of construction, methods and the arrangements of components set forth in the following description or illustrated in the drawings.

While embodiments have been illustrated and described in the drawings and foregoing description, such illustrations and descriptions are considered to be exemplary and not restrictive in character, it being understood that only illustrative embodiments have been shown and described and that all changes and modifications that come within the spirit of the disclosure are desired to be protected. The description and figures are intended as illustrations of embodiments of the disclosure, and are not intended to be construed as containing or implying limitation of the disclosure to those embodiments. There are a plurality of advantages of the present disclosure arising from various features set forth in the description. It will be noted that alternative embodiments of the disclosure may not include all of the features described yet still benefit from at least some of the advantages of such features. Those of ordinary skill in the art may readily devise their own implementations of the disclosure and associated methods, without undue experimentation, that incorporate one or more of the features of the disclosure and fall within the spirit and scope of the present disclosure and the appended claims.

The invention claimed is:

1. An assembly for securing to at least one wall mullion a plurality of sunshades each sunshade comprising a pair of mounting arms and shading structure extending between the mounting arms, the assembly comprising at least one mounting bracket including a pair of bracket elements matingly engagable with each other with one bracket element being securable to one mounting arm of one of the sunshades and the other bracket element being securable to one mounting arm of an other of the sunshades and with each bracket element being removably securable to the mullion, such that each bracket element is disengageable from the other bracket and element removable from the mullion;

wherein each bracket element comprises a plurality of tongues and defines a slot between each pair of tongues for receiving a respective tongue of the other bracket element to matingly engage the bracket elements; and wherein each bracket element includes a ledge disposed between each pair of tongues defining the slot and wherein each tongue includes a lip for engaging a respective ledge of the other bracket when the bracket elements are matingly engaged with each other.

2. An assembly for securing to a plurality of wall mullions a plurality of sunshades, each sunshade comprising a pair of mounting arms and shading structure extending between the mounting arms, the assembly comprising a plurality of mounting brackets, each mounting bracket for securing a respective pair of sunshades to a respective wall mullion, each mounting bracket including a pair of bracket elements matingly engageable with each other with one bracket element being securable to one mounting arm of one sunshade of the respective pair of sunshades and the other bracket element being securable to one mounting arm of an other sunshade of the respective pair of sunshades and with each bracket element being removably securable to the respective wall mullion, such that each bracket element is disengageable from the other bracket element and removable from the respective wall mullion;

each bracket element of each mounting bracket comprising a plurality of tongues and defines a slot between each pair of tongues for receiving a respective tongue of the other bracket element of the mounting bracket;

wherein each bracket element of each mounting bracket includes a ledge disposed between each pair of tongues defining the slot and wherein each tongue includes a lip for engaging a respective Ledge of the other bracket element of the mounting bracket when the bracket elements of the mounting bracket are matingly engaged with each other.

3. A sunshade assembly comprising:

(a) a plurality of wall mullions;

(b) a plurality of sunshades, each sunshade comprising a pair of parallel mounting arms and shading structure extending between the mounting arms;

(c) a plurality of fasteners;

(d) a plurality of mounting brackets for securing the sunshades, in a side-by-side manner, to the wall mullions, each mounting bracket securing one mounting arm from each of a respective pair of sunshades to a respective wall mullion, each mounting bracket comprising a pair of bracket elements matingly engaged with each other to define a channel, the channel receiving end portions of said one mounting arm from each of the respective pair of sunshades, each bracket element of each mounting bracket comprising a plurality of tongues and defining a slot between each pair of tongues, the slot receiving a respective tongue of the other bracket element of the mounting bracket to matingly engage the other bracket element, each tongue of each bracket element defining at least one aperture receiving a respective fastener removably and rigidly securing the bracket to the respective wall mullion such that each bracket element is disengageable from the other bracket element by unsecuring from the respective mullion the fasteners received by the tongues of the bracket element.

* * * * *